US010439369B1

(12) United States Patent
Niessner et al.

(10) Patent No.: US 10,439,369 B1
(45) Date of Patent: Oct. 8, 2019

(54) METHOD FOR PRODUCING AN ELECTRODE DEVICE FOR A SPARK PLUG

(71) Applicant: Federal-Mogul Ignition GmbH, Neuhaus-Schierschnitz (DE)

(72) Inventors: Werner Niessner, Steinheim (DE); Matthias Blankmeister, Heiligenhaus (DE)

(73) Assignee: FEDERAL-MOGUL IGNITION GMBH, Neuhaus-Schierschni (DE)

( * ) Notice: Subject to any disclaimer, the term of this patent is extended or adjusted under 35 U.S.C. 154(b) by 0 days.

(21) Appl. No.: 16/353,713

(22) Filed: Mar. 14, 2019

(30) Foreign Application Priority Data

Mar. 14, 2018 (DE) ..... 10 2018 105 928

(51) Int. Cl.
*H01T 21/02* (2006.01)
*H01T 13/39* (2006.01)

(52) U.S. Cl.
CPC ..... *H01T 21/02* (2013.01); *H01T 13/39* (2013.01)

(58) Field of Classification Search
CPC ..... H01T 21/02; H01T 13/39; H01T 13/28
See application file for complete search history.

(56) References Cited

U.S. PATENT DOCUMENTS 4,786,267 A 11/1988 Toya et al.
4,858,815 A 8/1989 Roberts et al.
5,430,346 A 7/1995 Johnson
5,856,724 A 1/1999 Chiu et al.
(Continued)

FOREIGN PATENT DOCUMENTS

DE 3825944 A1 2/1989
DE 102004034498 A1 2/2006
(Continued)

OTHER PUBLICATIONS

Office action issued by the German Patent and Trademark Office for application No. DE 10 2018 105 928.0.
(Continued)

*Primary Examiner* — Anne M Hines
(74) *Attorney, Agent, or Firm* — Reising Ethington, P.C.

(57) ABSTRACT

A method for producing an electrode device for a spark plug, with the following steps: preparation of an electrode body composed of a first material, the electrode body having a first joining surface; preparation of a precious metal part, which has a second joining surface; placement of the joining surfaces against each other and production of a relative movement between the joining surfaces during which the joining surfaces are pressed against each other with a first force ($F_1$) that is less than a force threshold ($F_S$); termination of the relative movement and pressing of the joining surfaces against each other for a pressing period ($T_A$) with a second force ($F_2$) that is greater than the force threshold ($F_S$) in such a way that a diffusion from the first and/or second material beyond the joining surfaces takes place; and termination of the pressing together, wherein the relative movement is a linear movement and/or an orbital movement.

5 Claims, 1 Drawing Sheet

(56) References Cited

U.S. PATENT DOCUMENTS

| | | | |
|---|---|---|---|
| 6,705,009 | B2 | 3/2004 | Niessner |
| 7,948,159 | B2 | 5/2011 | Lykowski |
| 8,049,399 | B2 | 11/2011 | Camilli |
| 8,747,176 | B2 | 6/2014 | Lynch et al. |
| 8,789,273 | B2 | 7/2014 | Janssen et al. |
| 8,922,102 | B2 | 12/2014 | Camilli |
| 9,041,275 | B2 | 5/2015 | Abe et al. |
| 9,083,155 | B2 | 7/2015 | Yoshizaki et al. |
| 9,705,292 | B2 | 7/2017 | Gozawa et al. |
| 10,312,669 | B2 * | 6/2019 | Sumoyama ..... H01T 13/39 |
| 2007/0252503 | A1 | 11/2007 | Rossi |
| 2008/0093420 | A1 | 4/2008 | Mauer |
| 2017/0145898 | A1 | 5/2017 | Schafer |

FOREIGN PATENT DOCUMENTS

| | | | |
|---|---|---|---|
| KR | 20060092691 | A | 8/2006 |
| WO | 2009034318 | A1 | 3/2009 |

OTHER PUBLICATIONS

Informal Translation of Office action issued by the German Patent and Trademark Office for application No. DE 10 2018 105 928.0.
Wikipedia article Reibschweißen, 4 pages.
Machine Translation of Wikipedia article Reibschweißen, 6 pages.

* cited by examiner

METHOD FOR PRODUCING AN ELECTRODE DEVICE FOR A SPARK PLUG

This application claims the benefit of German Application No. 2018 105 928.0, filed on Mar. 14, 2018, the contents of which are hereby incorporated by reference in their entirety.

FIELD

The present application relates to a method for producing an electrode device for a spark plug, the spark plug being embodied particularly for internal combustion engines particularly in motor vehicles.

BACKGROUND

Spark plugs can be used to initiate a combustion in internal combustion engines. Typically, spark plugs ignite a gas such as an air/fuel mixture, specifically in an engine cylinder or in a combustion chamber, in that a spark is produced transversely across a spark gap that is formed between two or more electrodes. The ignition of the gas by means of the spark triggers a combustion reaction in the engine cylinder, which is responsible for the power stroke of the engine. The high temperatures, the high electrical voltages, the rapid repetition of combustion reactions, and the presence of corrosive materials in the combustion gases can create a harsh environment in which the spark plug must function. The harsh environment can contribute to an erosion and to a corrosion of electrodes of spark plugs, which can negatively affect the performance of the spark plug over time. This in turn can potentially lead to misfires or other unwanted states.

To reduce erosion and corrosion of the electrodes of spark plugs, various kinds of precious metals and alloys have been used such as those that are composed of platinum and iridium. These materials are expensive, however. Consequently, the manufacturers of spark plugs try to minimize the quantity of precious metals used in an electrode. One approach to achieve this consists in using such materials only on an ignition tip or on a sparking section of the electrodes, i.e. in the place where a spark jumps across the spark gap.

Electrode devices for spark plugs typically include a central electrode device and a ground electrode device. The electrode devices preferably each have an electrode body composed of a first material that can be a metal or metal alloy such as a nickel alloy.

The electrode devices also preferably have an ignition tip that is at least partially made of a more precious metal material, for example iridium, platinum or ruthenium.

Various joining techniques are known for connecting the electrode body to the ignition tip, which can also be referred to as a precious metal part. Classically, the connection is produced by means of a welding method such as a laser welding method.

Document WO 2009/034318 A1 has disclosed a production method for an electrode with an iridium tip, which includes the step of joining the tip to a free end of the electrode by means of the friction welding method. The friction welding method is particularly carried out by means of a relative rotation between the tip and the electrode body while exerting a constant pressing force. The rotation is then ceased and the pressure is increased further until the relative rotation stops.

Document U.S. Pat. No. 9,705,292 B has disclosed a spark plug with a central electrode and a ground electrode.

The ground electrode has an ignition tip mounted on it. The ignition tip has a discharge layer and a stress-relieving layer. The stress-relieving layer is embodied of a Pt/Ni alloy and is joined to the opposing surface by means of a diffusion layer. The discharge layer is composed of a Pt/Rh alloy and is joined to one side of the stress-relieving layer by means of a diffusion layer, specifically to the side opposite from the side with which the stress-relieving layer is joined to the ground electrode.

In the connection between a precious metal and an electrode body, it should be noted that the materials to be joined in this case have different melting points and as a rule also different thermal coefficients of expansion. Furthermore, the two materials must meet mechanical, chemical, and thermal life cycle requirements.

In addition to the above-described joining techniques, it is also possible to connect electrode bodies and precious metal parts to each other by means of electrical resistance welding or by means of electron beam welding. The precious metal part frequently has melting points above 2000° C. Nickel-based alloys for electrode bodies frequently have melting points in a range between 1350° C. and 1450° C.

Specifically in combinations of iridium and nickel-based materials, fractures can occur in the connection regions, which can lead to failures. A remedy for this can be in embodying the weld zone as a continuous contact surface. It is also possible to avoid fractures by means of particularly homogeneous alloys. The preparation of such homogeneous alloys, however, is very time-consuming.

SUMMARY

In this context, an object of the present application is to disclose an improved method for producing an electrode device for a spark plug.

The above object may be attained first of all by means of a method for producing an electrode device for a spark plug, with the following steps:

- preparation of an electrode body composed of a first material, the electrode body having a first joining surface;
- preparation of a precious metal part, which has a second joining surface;
- placement of the joining surfaces against each other and production of a relative movement between the joining surfaces during which the joining surfaces are pressed against each other with a first force that is less than a force threshold;
- termination of the relative movement and pressing of the joining surfaces against each other for a pressing period with a second force that is greater than the force threshold in such a way that a diffusion from the first and/or second material beyond the joining surfaces takes place; and termination of the pressing together, wherein the relative movement is a linear movement and/or an orbital movement.

The above object may also be attained by means of a method for producing an electrode device for a spark plug, with the following steps:

- preparation of an electrode body composed of a first material, the electrode body having a first joining surface;
- preparation of a precious metal part, which has a second joining surface;
- placement of the joining surfaces against each other and production of a relative movement between the joining surfaces during which the joining surfaces are pressed against each other with a first force that is less than a force threshold;

termination of the relative movement and pressing of the joining surfaces against each other for a pressing period with a second force that is greater than the force threshold in such a way that a diffusion from the first and/or second material beyond the joining surfaces takes place; and termination of the pressing together, wherein the first joining surface is larger than the second joining surface; the relative movement is carried out in such a way that the second joining surface is moved within the first joining surface; before the termination of the relative movement, the second joining surface is brought into a position relative to the first joining surface in which the second joining surface, at least in some regions, is spaced apart from a circumferential edge of the first joining surface.

Preferred embodiments of the method are disclosed in the dependent claims.

The method according to the present application achieves the fact that the precious metal and the electrode body are joined to each other in the manner of a diffusion weld. In this connection, it is advantageous if during the joining process, no melting zones are produced in the region of the contact surfaces between the electrode body and the precious metal part. A bonding of one substance to the other does take place, but without producing a liquid phase. Instead, particle-level material (atoms, molecules, carriers) is transported beyond the joining surfaces.

Such a material transport of substances or particles can be activated through a heating of the joining zone; a new monolithic structure is produced in the connection region, particularly by means of a grain growth.

Whereas in the prior art, a pressing force is exerted for as long as a relative movement between the electrode body and the precious metal is produced, here, the proposal is after the end of the relative movement and thus after the heating of the joining zone—to increase the pressing force once again to a significant degree, specifically beyond a force threshold. In terms of its magnitude, this pressing force can correspond to a forging force.

The forging point that is produced by this is preferably not visible either macroscopically or microscopically.

Whereas in the prior art, a relative movement between the electrode body and the precious metal is generally produced by means of a relative rotation, according to the first aspect of the present application, it is proposed to carry out the relative rotation as a relative linear movement and/or as a relative orbital movement.

This measure makes it possible to connect an electrode body and a precious metal part to each other when at least one of their joining surfaces is not embodied as rotationally symmetrical. The method is therefore particularly suitable for connecting a ground electrode body to a precious metal part, with the ground electrode body being embodied as a wire section that is typically approximately rectangular in cross-section.

With the linear movement and/or the orbital movement, generally the smaller second joining surface is moved relative to the first joining surface, with the relative motion being carried out so that the second joining surface is moved within the first joining surface. In other words, the first joining surface on the electrode body occupies an area that is greater than the second joining surface of the precious metal part.

The precious metal part is preferably embodied as circular when viewed axially from above, but can also be embodied as a square or rectangular precious metal part.

With a linear movement, the first joining surface is preferably formed by a rectangular section and two semi-circular sections on opposite sides of the rectangular section. With an orbital movement, the first joining surface is circular or cloud-shaped depending on whether or not a purely orbital movement is also superposed with an additional movement.

The object may be fully attained.

According to a preferred embodiment of the first method, the orbital movement is a multi-orbital movement in which a relative orbital movement and a relative rotating movement are superposed with each other.

This makes it possible to achieve a uniform heating of the joining zone.

With the first method, it is also advantageous if the electrode body is an elongated body, which has an electrode body longitudinal axis, and the linear relative movement takes place parallel to the electrode body longitudinal axis.

By and large, it is advantageous if at least the second joining surface is a polygonal surface and/or a surface that is at least partially composed of circular arcs.

In the first case, the shape of the precious metal part can be polygonal, e.g. triangular, square, pentagonal, etc. In the second case, the shape of the precious metal part is circular or elliptical, for example, when viewed from above.

Naturally, the features described above and the features to be described in greater detail below can be used not only in the respectively indicated combination, but also in other combinations or by themselves without going beyond the scope of the present invention.

DRAWINGS

Exemplary embodiments are shown in the drawings and will be explained in greater detail below. In the drawings.

DESCRIPTION

Figure 1:
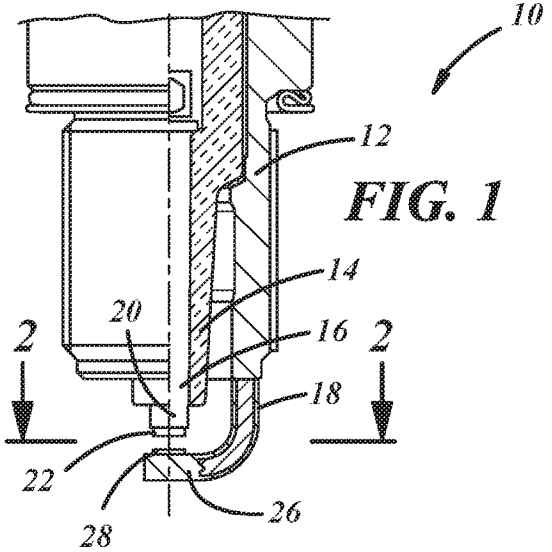
FIG. 1 is a schematic depiction of a part of a spark plug, which has an electrode device produced according to the present application.

FIG. 1 schematically depicts a spark plug 10 that is designed particularly for use in an internal combustion engine of a motor vehicle.

In an intrinsically known way, the spark plug 10 has a metal sleeve 12 that can include an external thread in order to screw the spark plug into a cylinder head. The spark plug 10 also has an insulator 14, which is positioned radially inside an axial bore of the metal sleeve 12.

A central electrode device 16 that extends in the axial direction is mounted in an axial bore of the insulator 14.

The metal sleeve 12 is mechanically and electrically connected to a ground electrode device 18. For example, the ground electrode device 18 extends from the metal sleeve 12 in an L shape when viewed from the side.

The central electrode device 16 has a central electrode body 20 that extends axially relative to the insulator 14 toward the ground electrode device 18. The central electrode body 20 is preferably circular in cross-section. At a front end that is oriented toward the ground electrode device 18, the central electrode body 20 is connected to a central electrode ignition tip 22, which is embodied as a precious metal part that contains at least one of the following precious metal components or is entirely composed thereof: platinum, iridium, ruthenium, alloys of platinum, iridium, ruthenium, etc.

The ground electrode device 18 has a ground electrode body 26, which is embodied as a wire that is essentially rectangular in cross-section and has a section extending parallel to a longitudinal axis of the spark plug 10 that is connected to the metal sleeve 12. The ground electrode body 26 also has a section, which extends transversely to a point below the central electrode device 16 and is connected to the axially extending section by means of a curved section so that in the side view shown in FIG. 1, an L-shaped configuration is produced.

The ground electrode device 18 also has a ground electrode ignition tip 28, which is embodied as a precious metal part. The ground electrode ignition tip 28 is positioned coaxial to the central electrode ignition tip 22 in such a way that between the central electrode ignition tip 22 and the ground electrode ignition tip 28, an ignition gap is produced, which constitutes a spark gap. In an intrinsically known way, a spark that jumps across the spark gap can ignite a gas/fuel mixture in a combustion chamber of an internal combustion engine in order to initiate or maintain an internal combustion engine process.

The ground electrode ignition tip 28 can be embodied as circular when viewed from above.

The ignition tips 22, 28, as described above, can each be embodied as precious metal parts, which each have one of the following components: platinum, iridium, ruthenium, a platinum alloy, an iridium alloy, a ruthenium alloy, etc.

Figure 2:
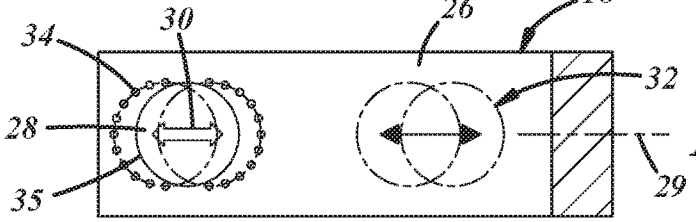
FIG. 2 is a schematic sectional view along a line II-II in FIG. 1, with a relative linear movement being used to produce an electrode device.

The section of the ground electrode body 26 extending transversely to the longitudinal axis of the spark plug 10 has a ground electrode longitudinal axis 29, which is schematically indicated in FIG. 2.

FIG. 2 schematically depicts (and, for the sake of clarity, not in the same proportions as FIG. 1) a sectional view along the line II-II in FIG. 1 that is specifically focused on an inside of the transversely extending section of the ground electrode body 26 facing the central electrode device 16, with the ground electrode ignition tip 28 affixed thereto, which is circular in cross-section.

FIG. 2 also shows the way in which the precious metal part is mounted onto the electrode body, specifically by means of a relative movement during which joining surfaces of the electrode body and precious metal part are joined to each other.

In the present case, the relative movement between the electrode body and the precious metal part is a linear movement that is oriented parallel to the longitudinal axis 29 of the transverse section of the ground electrode body 26. FIG. 2 schematically depicts the linear movement as a double arrow pointing in a back-and-forth direction and schematically depicted next to this, also shows a movement pattern 32 of this relative linear movement.

By means of the relative linear movement 30 during the joining process, a first joining surface 34 on the ground electrode body 26 is produced, which is composed of a central rectangular section and two semicircular sections, as shown in FIG. 2. A joining surface 35 of the ground electrode ignition tip 28 corresponds to an entire axial surface of the ground electrode ignition tip 28 and is therefore embodied as circular.

The end position in which the ground electrode ignition tip 28 is joined to the ground electrode body 26 is depicted with a solid line in FIG. 2. Starting from this position, the relative linear movement 30 travels parallel to the longitudinal axis 29 in the one direction and then in the other direction so that over time, a sinusoidal curve for the relative movement is produced, as is schematically depicted by s in FIG. 5.

Figure 5:
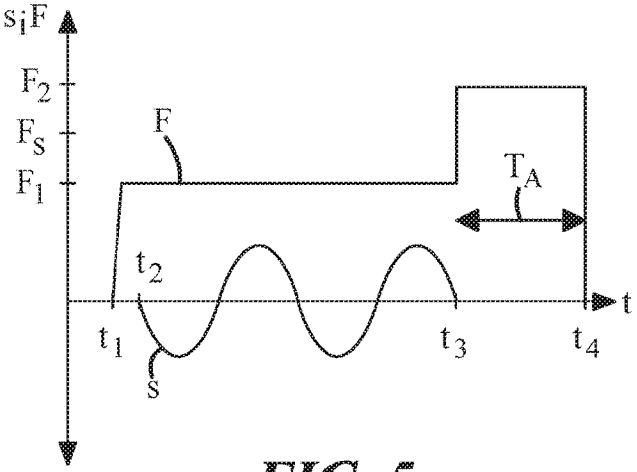
FIG. 5 is a timing diagram depicting the relative movement between the electrode body and the precious metal part during the production method and depicting the forces involved.

FIG. 5 shows the curve over time of a method for producing an electrode device, in the present case the ground electrode device 18.

At a time $t_1$, the joining surfaces 34, 35 are placed against each other and pressed against each other with a first force $F_1$. Then at a time $t_2$, the linear relative movement begins, which is labeled with the letter s in FIG. 5 and which extends essentially in a sinusoidal curve. Due to the relative movement during which the joining surfaces 34, 35 are being joined to each other, the joining surfaces 34, 35 are heated. The sequence in this case is that the heating is carried out to a temperature that is below the melting point of a main ingredient of the precious metal part, in particular less than 2000° C. Preferably, the temperature is also below a melting temperature of the material of the ground electrode body 26, which is preferably a nickel alloy.

Preferably, the temperature is below 1400° C.

At a time t3, the relative movement ends (s=0, which corresponds to the position of the ground electrode ignition tip 28 depicted with solid lines in FIG. 2). Immediately after this, the force F with which the joining surfaces 34, 35 are pressed against each other is increased again, specifically to a value $F_2$.

The second force $F_2$ is greater than a force threshold $F_s$, which is in turn greater than the force $F_1$ with which the joining surfaces 34, 35 are pressed against each other during the relative movement.

Through the heating of the joining surfaces 34, 35 by means of the relative movement and the subsequent pressing against each other with a powerful second force $F_2$, a diffusion bonding or welding of the ground electrode body 26 to the ground electrode ignition tip 28 takes place such that a diffusion of material from the ground electrode body 26 and/or material from the ground electrode ignition tip 28 through the joining surfaces 34, 35 into the respective other material takes place. This diffusion process can correspond to a forging process in this case.

After manufacture, in the region of the joining surfaces 34, 35, an essentially seamless transition is produced, which yields a kind of monolithic structure, preferably by means of a material transport through the joining surfaces and a corresponding grain growth.

The joining connection is preferably not visible either macroscopically or microscopically.

At time $t_4$, the force F is reduced to 0 again. The joining procedure is ended.

FIG. 2 shows that the first joining surface 34 is larger than the second joining surface 35; the relative movement is carried out so that the second joining surface 35 is moved within the first joining surface 34; before the termination of the relative movement, the second joining surface 35 is brought into a position relative to the first joining surface 34 in which the second joining surface 35, at least in some regions, is spaced apart from a circumferential edge of first joining surface 34.

Figure 3:
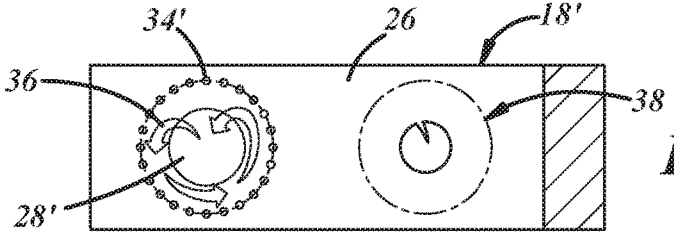
FIG. 3 is a depiction comparable to FIG. 2, with a relative orbital movement being used to produce the electrode device.
Figure 4:
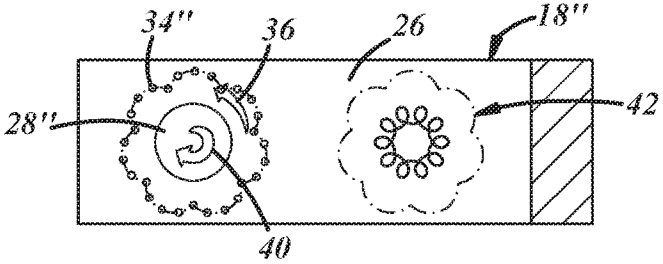
FIG. 4 is a depiction comparable to FIG. 2, with a relative multi-orbital movement being used to produce the electrode device.

FIGS. 3 and 4 show other embodiments of methods for producing electrode devices, which in terms of the sequence, generally correspond to the embodiment described with reference to FIGS. 1, 2 and 5. The same elements have therefore been provided with the same reference numerals. Essentially, the differences will be explained below.

FIG. 3 shows a method in which the relative movement between the ground electrode body 26 and the ground electrode ignition tip 28' is produced by means of an orbital movement 36 in which the ground electrode ignition tip 28' is moved eccentrically to a center point position on a circular path, as is apparent from the orbital movement pattern 38 in FIG. 3.

The first joining surface 34' that this produces on the ground electrode body 26 has an essentially circular form in this case, the diameter of which is greater than the diameter of the ground electrode ignition tip 28'. With this orbital movement 36, the ground electrode ignition tip 28' either cannot rotate or can rotate around its own central axis.

FIG. 4 shows a relative movement between the ground electrode body 26 and the ground electrode ignition tip 28" in the form of a multi-orbital movement in which an orbital movement 36 and an in particular eccentric rotating movement 40 of the ground electrode ignition tip 28" around a longitudinal axis of the ground electrode ignition tip 28" can be superposed.

This produces a multi-orbital pattern 42. The first joining surface 34" is generally circular and on its outer circumference, is composed of a plurality of circular arcs that adjoin one another in the circumference direction, i.e. is "cloud shaped" so to speak.

The above-described joining methods can be referred to as diffusion welding methods or as friction welding methods. The joining methods are preferably carried out so that the materials do indeed plasticize at their joining surfaces, but preferably do not melt. As a result, a welding bead can be produced in a circumference region around the ground electrode ignition tip 28.

Methods for connecting a ground electrode ignition tip 28 to a ground electrode body 26 are also shown above. Naturally, the above methods can be applied in the same way to the use of a central electrode ignition tip 22 on a central electrode body 20.

The shape of the ground electrode ignition tip 28 is not limited to a circular shape. The shape can be a polygonal shape, in particular a square shape.

The ground electrode ignition tip 28 and/or the central electrode ignition tip 22 can be produced from one piece, but can also consist of two or more layers. In this case, a precious metal layer is preferably positioned facing the respective other ignition tip. Another layer can then be positioned facing the respective electrode body.

The material of this middle layer can be an alloy material with a value between that of the precious metal layer and that of the respective electrode body.

It is to be understood that the foregoing is a description of one or more preferred exemplary embodiments of the invention. The invention is not limited to the particular embodiment(s) disclosed herein, but rather is defined solely by the claims below. Furthermore, the statements contained in the foregoing description relate to particular embodiments and are not to be construed as limitations on the scope of the invention or on the definition of terms used in the claims, except where a term or phrase is expressly defined above. Various other embodiments and various changes and modifications to the disclosed embodiment(s) will become apparent to those skilled in the art. All such other embodiments, changes, and modifications are intended to come within the scope of the appended claims.

As used in this specification and claims, the terms "for example," "e.g.," "for instance," "such as," and "like," and the verbs "comprising," "having," "including," and their other verb forms, when used in conjunction with a listing of one or more components or other items, are each to be construed as open-ended, meaning that the listing is not to be considered as excluding other, additional components or items. Other terms are to be construed using their broadest reasonable meaning unless they are used in a context that requires a different interpretation.

The invention claimed is:

1. A method for producing an electrode device for a spark plug, with the following steps:

preparation of an electrode body composed of a first material, the electrode body having a first joining surface;

preparation of a precious metal part, which has a second joining surface;

placement of the first and second joining surfaces against each other and production of a relative movement between the first and second joining surfaces during which the first and second joining surfaces are pressed against each other with a first force ($F_1$) that is less than a force threshold ($F_S$);

termination of the relative movement and pressing of the first and second joining surfaces against each other for a pressing period ($T_A$) with a second force ($F_2$) that is greater than the force threshold ($F_S$) in such a way that a diffusion from the first and/or second material beyond the first and second joining surfaces takes place; and termination of the pressing together, wherein the relative movement is a linear movement and/or an orbital movement.

2. The method according to claim 1, wherein the orbital movement is a multi-orbital movement in which a relative orbital movement and a relative rotating movement are superposed with each other.

3. The method according to claim 1, wherein the electrode body is an elongated body, which has an electrode body longitudinal axis, and the linear relative movement takes place parallel to the electrode body longitudinal axis.

4. The method according to claim 1, wherein at least the second joining surface is a polygonal surface or a surface that is composed of circular arcs.

5. A method for producing an electrode device for a spark plug, with the following steps:

preparation of an electrode body composed of a first material, the electrode body having a first joining surface;

preparation of a precious metal part, the precious metal part having a second joining surface;

placement of the first and second joining surfaces against each other and production of a relative movement between the first and second joining surfaces during which the first and second joining surfaces are pressed against each other with a first force ($F_1$) that is less than a force threshold ($F_S$);

termination of the relative movement and pressing of the first and second joining surfaces against each other for a pressing period ($T_A$) with a second force ($F_2$) that is greater than the force threshold ($F_S$) in such a way that a diffusion from the first and/or second material beyond the first and second joining surfaces takes place; and termination of the pressing together, wherein the first joining surface is larger than the second joining surface; the relative movement is carried out in such a way that the second joining surface is moved within the first joining surface; before the termination of the relative movement, the second joining surface is brought into a position relative to the first joining surface in which the second joining surface, at least in some regions, is spaced apart from a circumferential edge of the first joining surface.

* * * * *